US007802773B2

(12) United States Patent
Murphy

(10) Patent No.: US 7,802,773 B2
(45) Date of Patent: Sep. 28, 2010

(54) REUSABLE FALL RESTRAIN SUPPORTS AND FALL ARRESTOR

(75) Inventor: Thomas J. Murphy, Middlesex, NJ (US)

(73) Assignee: PPP 2007 Royalty Trust, Middlesex, NJ (US)

( * ) Notice: Subject to any disclaimer, the term of this patent is extended or adjusted under 35 U.S.C. 154(b) by 0 days.

(21) Appl. No.: 12/047,125

(22) Filed: Mar. 12, 2008

(65) Prior Publication Data

US 2008/0157046 A1 Jul. 3, 2008

Related U.S. Application Data

(60) Provisional application No. 60/908,963, filed on Mar. 29, 2007.

(51) Int. Cl.
*E04H 17/14* (2006.01)

(52) U.S. Cl. ..... 256/65.14; 256/DIG. 6

(58) Field of Classification Search ..... 256/32, 256/47, 48, 65.14, DIG. 6; 411/171, 389, 411/427
See application file for complete search history.

(56) References Cited

U.S. PATENT DOCUMENTS 3,880,405 A * 4/1975 Brueske ..... 256/59
3,893,579 A * 7/1975 Glewwe
4,236,698 A 12/1980 Compte
4,480,819 A 11/1984 Lopez
4,600,332 A * 7/1986 Sharp et al. ..... 411/171
4,666,131 A 5/1987 Kettelkamp, Sr. et al.
4,787,475 A 11/1988 Arteau et al.
5,154,256 A 10/1992 Wood
5,182,889 A 2/1993 Johnson
5,263,550 A 11/1993 Jines et al.
5,314,167 A 5/1994 Holloman
5,353,891 A 10/1994 Griek et al.
5,377,958 A 1/1995 Palmer
5,431,372 A 7/1995 Kostenecky
5,464,070 A 11/1995 Griek et al.
5,558,312 A 9/1996 Brennan
5,570,559 A 11/1996 Lewis
5,586,423 A 12/1996 Mullen
5,647,451 A 7/1997 Reichel
5,683,074 A 11/1997 Purvis et al.
5,711,398 A 1/1998 Bartholomew (Continued)

FOREIGN PATENT DOCUMENTS

EP 455888 A2 * 11/1991

(Continued)

*Primary Examiner*—Victor Macarthur
(74) *Attorney, Agent, or Firm*—Alix, Yale & Ristas, LLP

(57) ABSTRACT

A system for providing re-usable safety support fences and fall restraints for the construction industry. The system comprises a plurality of disposable bases which are welded to I-beams or otherwise permanently attached to a floor or roof, and a plurality of removable support posts that screw into the disposable bases. The support posts form the posts of a safety fence through which steel cables are threaded to form a fence. Also, a fall arrestor, comprising an eye hook onto which a construction or maintenance worker on the perimeter of a building may attach, can be screwed into the permanently mounted disposable base. Additional embodiments for use with concrete construction instead of steel I-beams are disclosed.

21 Claims, 19 Drawing Sheets

U.S. PATENT DOCUMENTS

| | | | |
|---|---|---|---|
| 5,842,685 | A | 12/1998 | Purvis et al. |
| 5,931,424 | A | 8/1999 | Kerber |
| 6,038,829 | A | 3/2000 | Franks |
| 6,039,150 | A | 3/2000 | Palmer |
| 6,053,281 | A | 4/2000 | Murray |
| 6,220,577 | B1 | 4/2001 | Ostrow |
| 6,270,057 | B1 | 8/2001 | Highley et al. |
| 6,272,800 | B1 | 8/2001 | Phinney et al. |
| 6,279,880 | B1 | 8/2001 | Hawks, Jr. |
| 6,336,623 | B1 | 1/2002 | McCarthy |
| 6,502,663 | B2 | 1/2003 | Ecker et al. |
| 6,540,209 | B2 | 4/2003 | Ross |
| 6,679,482 | B2 | 1/2004 | Allenbaugh |
| 6,681,528 | B1 | 1/2004 | Profeta et al. |
| 6,763,910 | B2 | 7/2004 | Cole |
| 6,779,629 | B2 | 8/2004 | Ecker et al. |
| 6,857,504 | B1 | 2/2005 | Branter |
| 6,908,075 | B1 | 6/2005 | Nichols |
| 6,926,241 | B2 | 8/2005 | Garrett |
| 6,931,793 | B2 | 8/2005 | Joyce et al. |
| 7,028,990 | B2 | 4/2006 | Shorey et al. |
| 7,032,891 | B2 | 4/2006 | Rowley et al. |
| 7,048,090 | B2 | 5/2006 | Dean et al. |
| 7,063,186 | B1 | 6/2006 | Granke |

FOREIGN PATENT DOCUMENTS

| | | | |
|---|---|---|---|
| JP | 464658 | A * | 2/1992 |

* cited by examiner

FIG. 13B
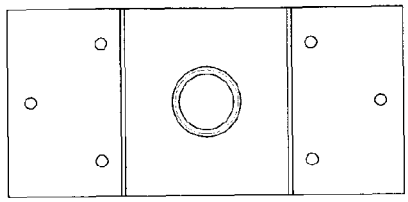
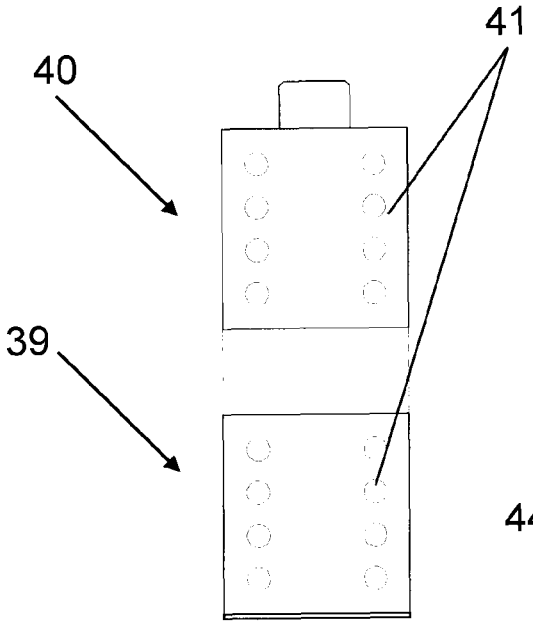
FIG. 13C
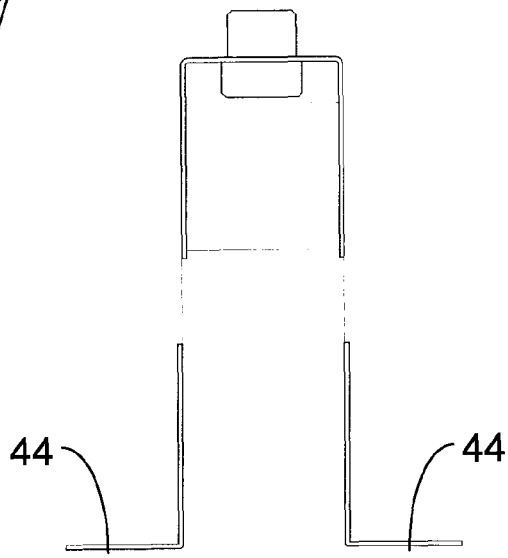
FIG. 13D

FIG. 14A
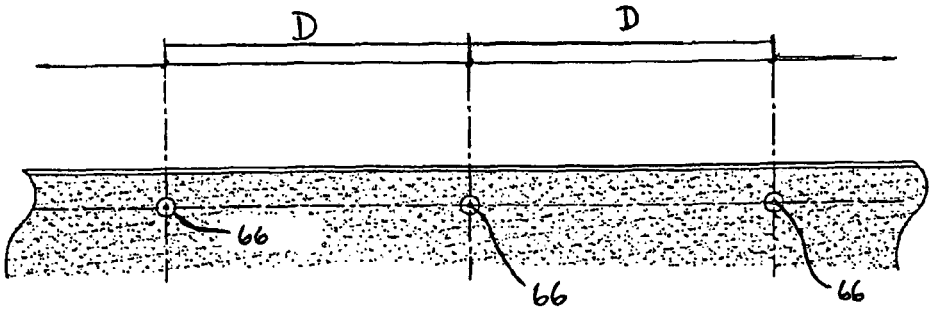
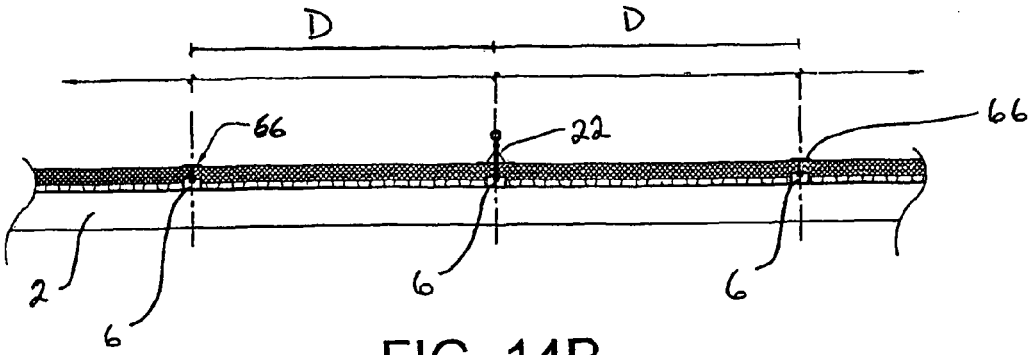
FIG. 14B

REUSABLE FALL RESTRAIN SUPPORTS AND FALL ARRESTOR

CROSS REFERENCE TO RELATED APPLICATIONS

This Present application is the non-provisional counterpart of U.S. Provisional Application Ser. No. 60/908,963 (hereinafter the '963 application) filed on Mar. 9, 2007, into which the entire disclosure of U.S. Provisional Patent Application No. 60/825,670 was incorporated by reference, the entire disclosures both of which are incorporated herein by reference.

BACKGROUND

OSHA requires that construction workers working on high rise buildings are protected from falling by restraining devices. The Occupational Safety and Health Administration (OSHA) requires fall protection devices to be positioned around building perimeters, interior stairwells, and elevator shafts over six feet above grade. The most common method used by contractors is welding 4-ft 4-in ×4-in ×¼-in steel angles having holes drilled at the appropriate height to conform to OSHA requirements (see FIG. 1). The angle posts 3 are positioned vertically, as depicted, thereby forming support posts. OSHA requires that successive posts be positioned no further than eight feet apart. Two steel cables 5 are normally threaded horizontally through the holes connecting the posts and forming a fence. The bottom 4 of the posts are welded to an I-beam 2. A flooring material 1 then covers the weld. FIG. 2 shows a single angle bracket 3 welded to an I-beam 2 at its bottom 4 with steel cables 5 threaded through the holes.

Once a story has been constructed, the safety fence is no longer required and must be removed prior to enclosure of the story. Once the steel cables are removed from the posts, post removal is commonly accomplished by cutting the post bracket near the floor/roof line. After such cutting, the brackets have a height that is shorter than the OSHA required 42-inches. Thus the brackets cannot be re-used for subsequent projects and become scrap metal. New posts must be used on each subsequent story construction, a rather costly practice.

There have been a number of attempts to solve this problem with reusable protection systems. In almost all known systems, each fence post comprises a horizontal base and a vertical post. Normally, the base and post form an integral unit. Now, these attempts at creating a reusable support include:

- screwing the base to the floor;
- clamping the base to the floor;
- a combination of screwing and clamping the base to the floor; and,
- securing the base to the floor with a peg-in-slot mechanism.

It has been found that screwing the base to the floor is not practical when securing the base to a steel I-beam. A single unit base and post also does not allow for an attachment point for future use of accessories. Clamping devices do not allow construction to be completed (including "closing in" the floors and roof) without the removal of the device. Of particular note is U.S. Pat. No. 4,480,819 to Lopez for an "Attachable/Detachable Railing Device" which teaches a post that screws into a base which is secured to the grating of an offshore oil platform via a peg-in-slot method. This is impractical for building construction because it requires a grating.

The disclosed system is designed for use preferably in the construction industry, particularly with regard to high-rise buildings. None of the prior art has been implemented in this industry despite a long-felt need for a more cost-effective safety system. The disclosed embodiments provide a base plate with a removable support post. The base plate is welded to an I-beam, and the support post is reusable.

SUMMARY OF THE INVENTION

The disclosed system provides re-usable OSHA compliant safety support fences and fall restraints for the construction industry. The system comprises a disposable base which is welded to an I-beam or otherwise permanently attached to a floor or roof and a removable support post that screws into the disposable base. The support posts can form the posts of a safely fence through which steel cables are threaded to form a fence. A fall arrestor, comprising an eye hook onto which a construction or maintenance worker on the perimeter of a building may attach, can also be screwed into the permanently mounted disposable base. Additional embodiments for use with concrete construction instead of steel I-beams are disclosed. The embodiments provide inexpensive disposable bases which remain an integral part of the structure after construction coupled with removable and re-usable post devices which screw into the disposable bases.

Figure 12A:
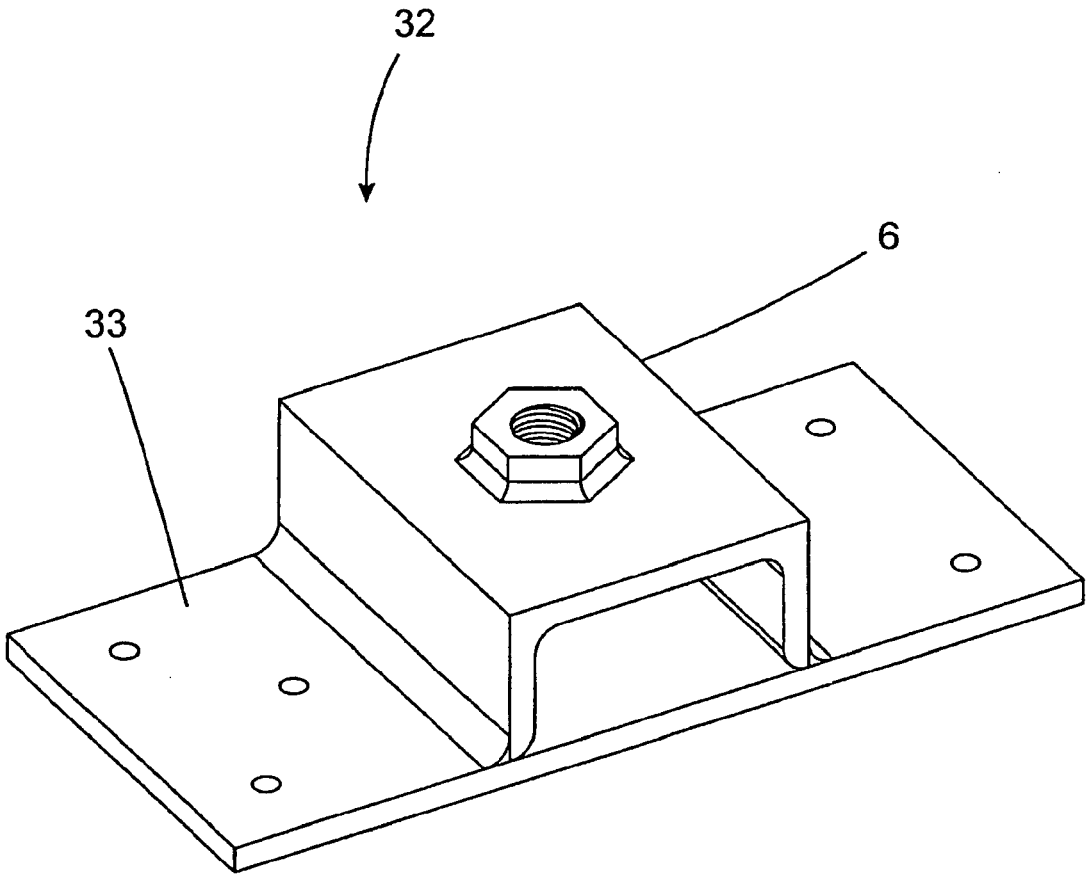
FIG. 12A is an isometric view of another embodiment of the re-usable base plate welded to a plate.
Figure 12B:
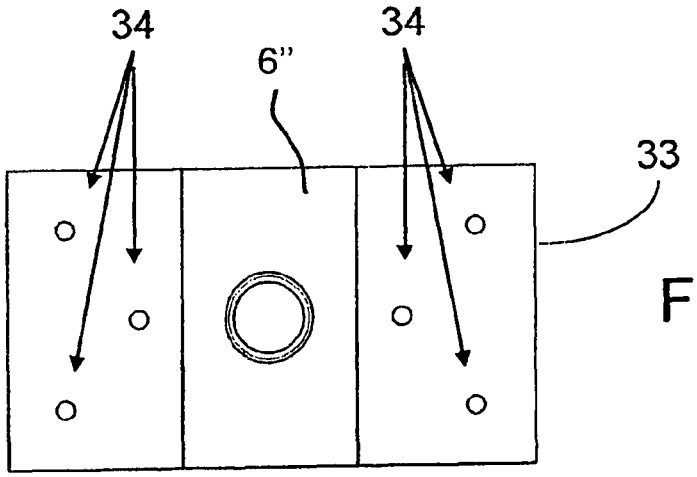
Figure 12C:
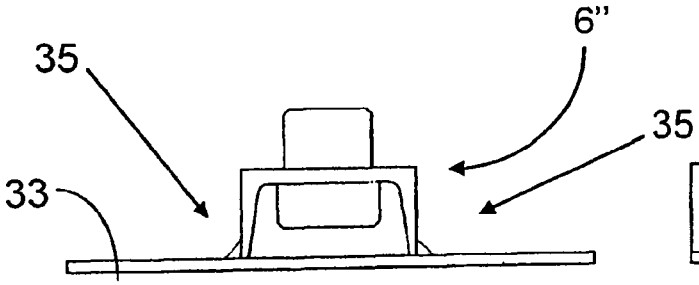
Figure 12D:
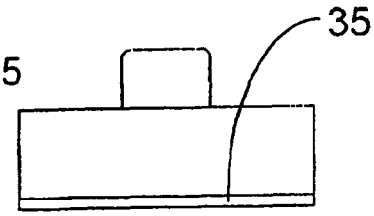
Figure 13A:
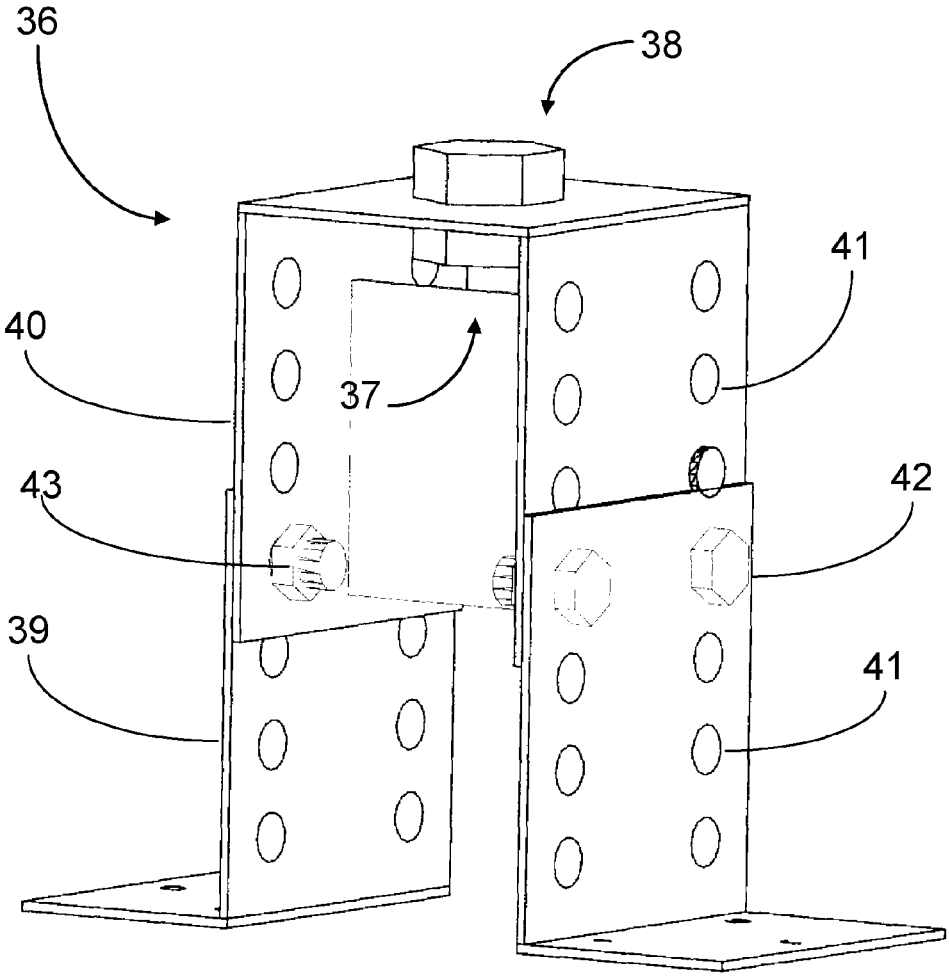

FIB. 12B is a top plan view of the re-usable base of FIG. 12A;

FIG. 12C is a front elevational view of the re-usable base of FIG. 12A;

FIG. 12D is a side elevational view of the re-usable base of FIG. 12A;

FIG. 13A is an isometric view of a two-part base plate for use with structural concrete, rather then steel I-beam construction;

FIG. 13B is a top plan view of the two-part concrete base plate of FIG. 13A;

FIG. 13C is a front elevational exploded view of the two-part concrete base plate of FIG. 13A;

FIG. 13D is a side elevational exploded view of the two-part concrete base plate of FIG. 13A;

FIG. 14A is a top plan view of the recessed base plates located at a building perimeter every eight feet apart; and FIG. 14B is a cross section elevational view of the recessed base plates, showing a removable fall arrestor positioned in the center of the drawing.

DETAILED DESCRIPTION

Figure 1:
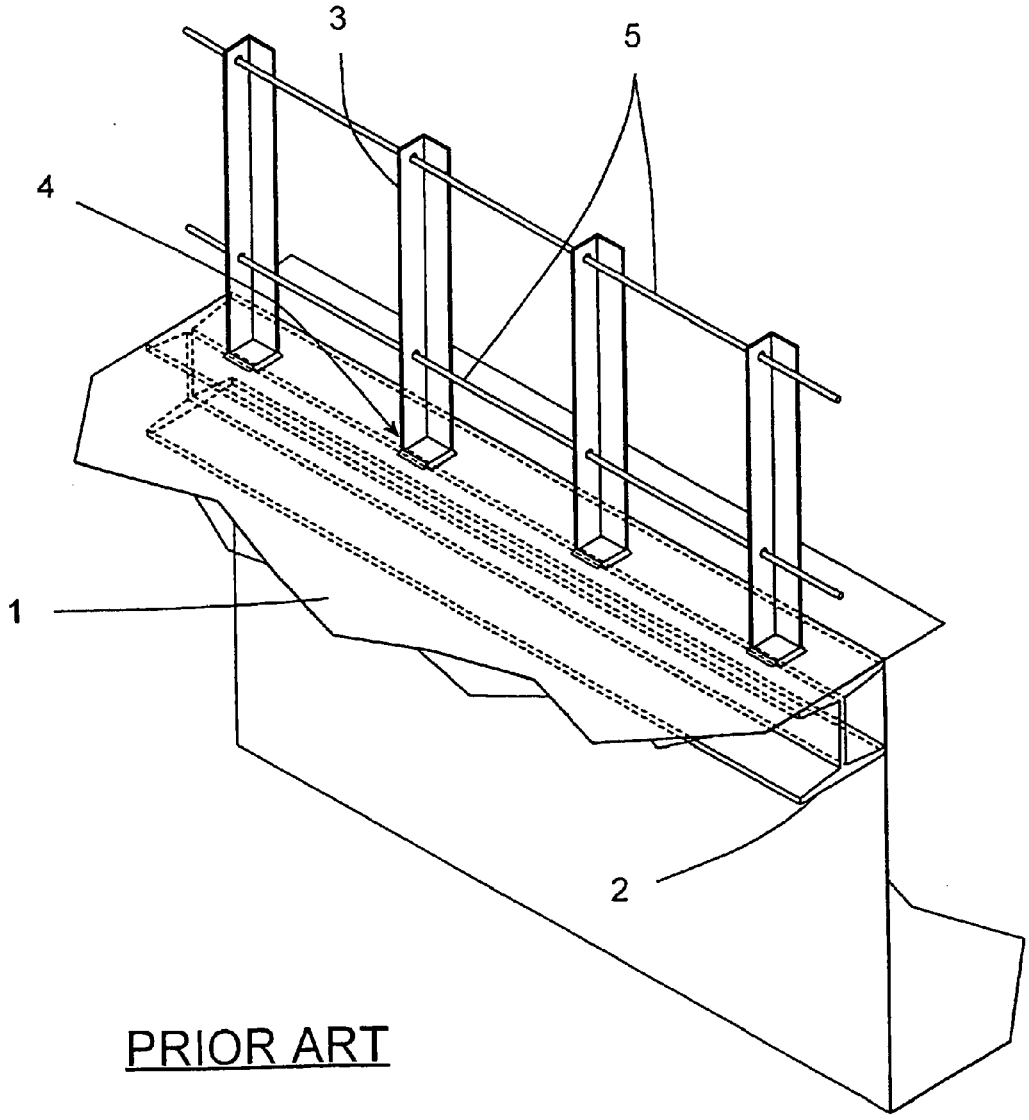
FIG. 1 is an isometric view of a prior art safety fence on a story under construction.
Figure 2:
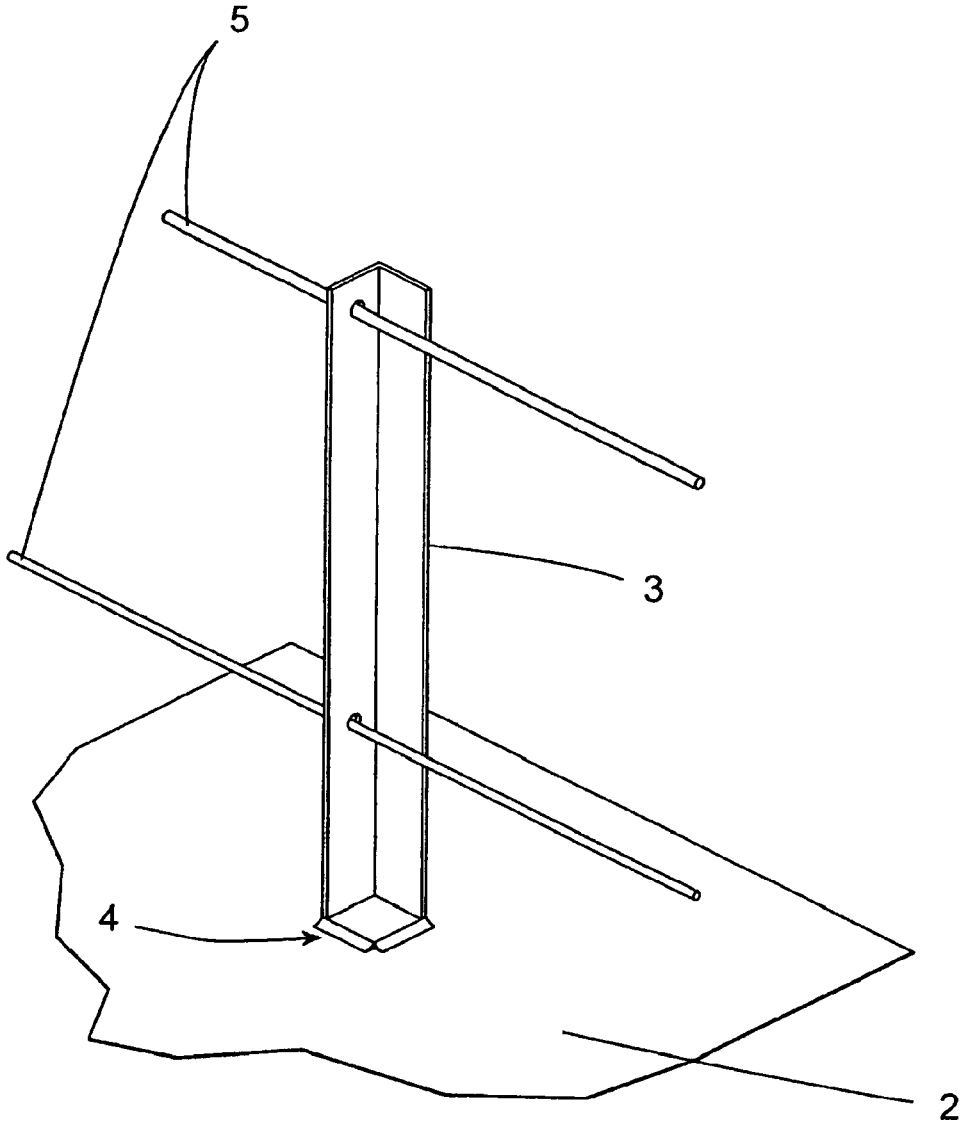
PRIOR ART FIG. 2
FIG. 2 is an isometric view of a single support post of the FIG. 1 embodiment.
Figure 3A:
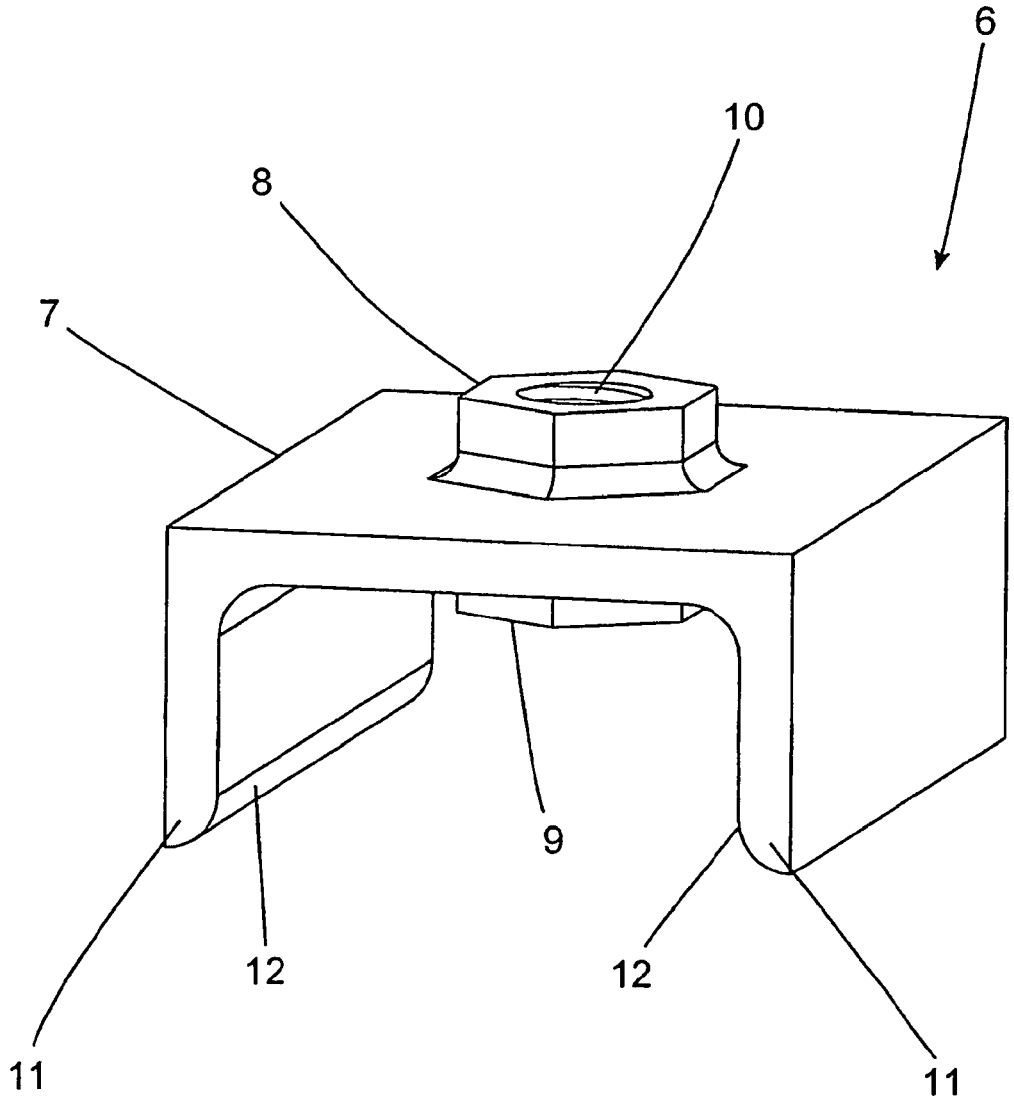
FIG. 3A is an isometric view showing a first embodiment of the disposable base according to the disclosure.
Figure 3B:
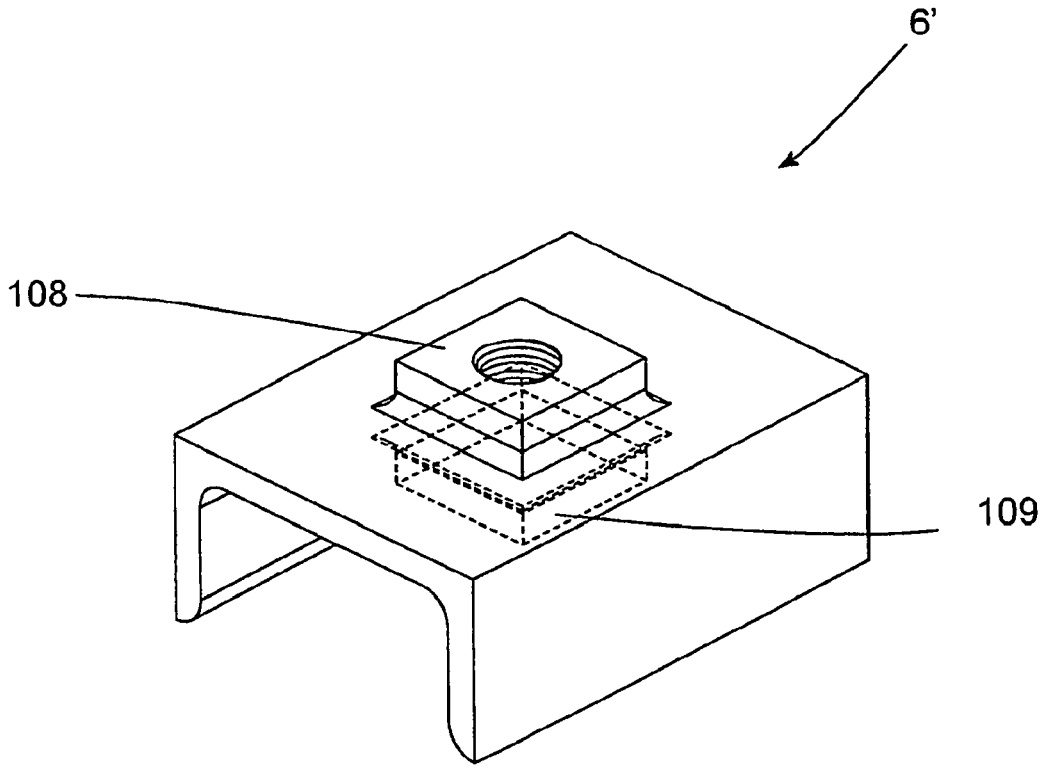
FIG. 3B is an isometric view showing a second embodiment of the disposable base.
Figure 3C:
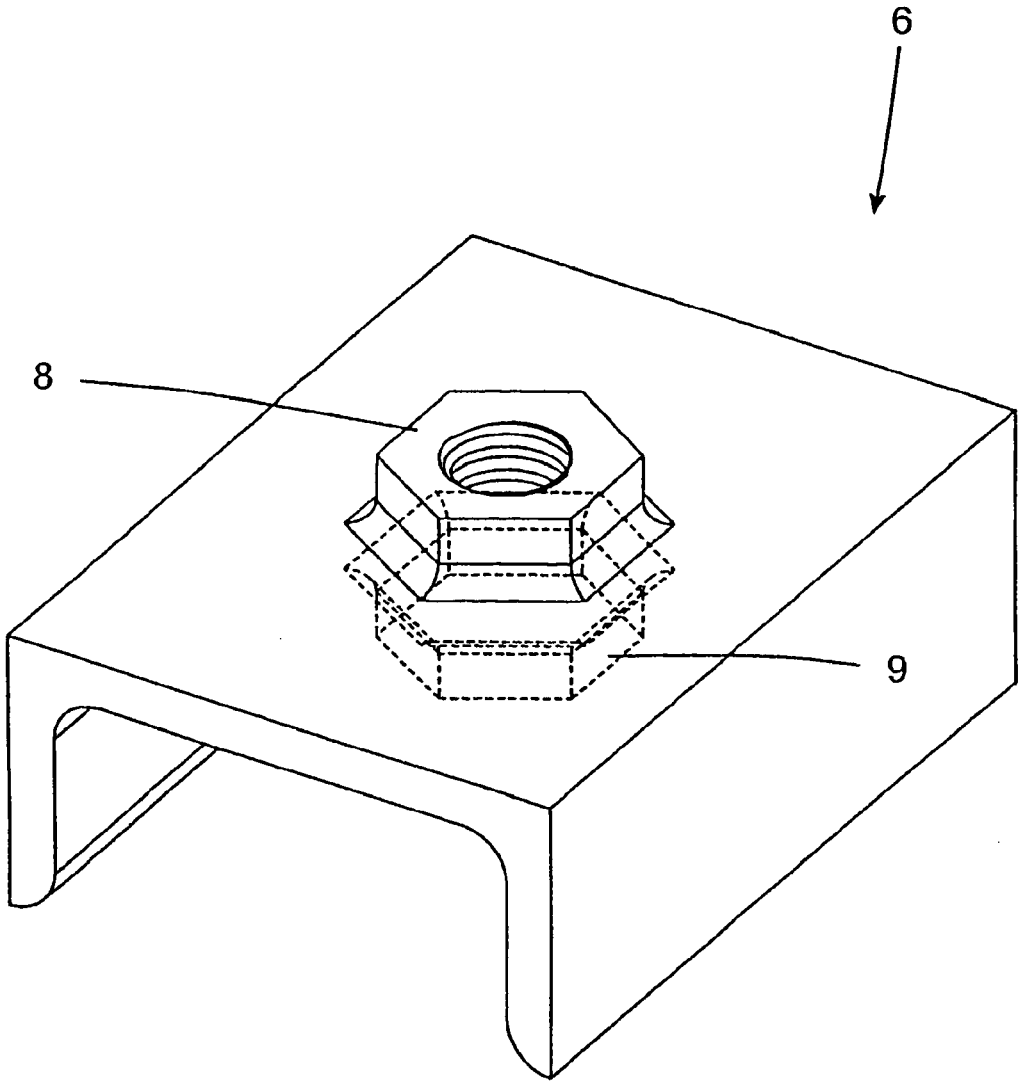
FIG. 3C is an isometric view of the embodiment of FIG. 3A from a different viewpoint.

The reusable fall restraint support system comprises a disposable base and a reusable post. The base is welded to the I-beam. The post is then screwed into the base. FIG. 3A, FIG. 3B, and FIG. 3C are isometric drawings of two slightly different embodiments of the disposable base. With reference to the embodiment of FIG. 3A and 3C, the disposable base 6 comprises a section of a C-Channel 7 and two nuts 8 and 9 having female screw threads 10—the nuts being welded to opposite sides (top and bottom) of the "C" as shown. The two nuts act as female receptors into which the reusable post will be screwed. The disposable base is very inexpensive to manufacture and can be sold for a very low price. The embodiment of the base 6 depicted in FIG. 3A and FIG. 3C uses hexagonal nuts 8 and 9, while the embodiment of the base 6' depicted in FIG. 3B uses square nuts 108 and 109. In a variation of the previously disclosed embodiments, a single nut with a female screw thread may be inserted into the hole in the top horizontal portion of the disposable base such that part of the nut protrudes above the outside surface of the horizontal top portion, and part of the nut protrudes below the inside surface of the horizontal top portion (see FIG. 4). Clearly other types of fasteners can be used. The base is positioned on the I-beam with the web of the "C" higher than its two sides. The two vertical flanges 12 of the "C" are then welded at 11 onto the beam in this position. In any event, the base becomes part of the structure. Once construction of the story has been completed and the safety fence is no longer required, the reusable support post can be unscrewed from the base. The base remains in the beam. Usually the concrete floor is built up so that the base will remain encapsulated within the floor after construction is complete.

Figure 4:
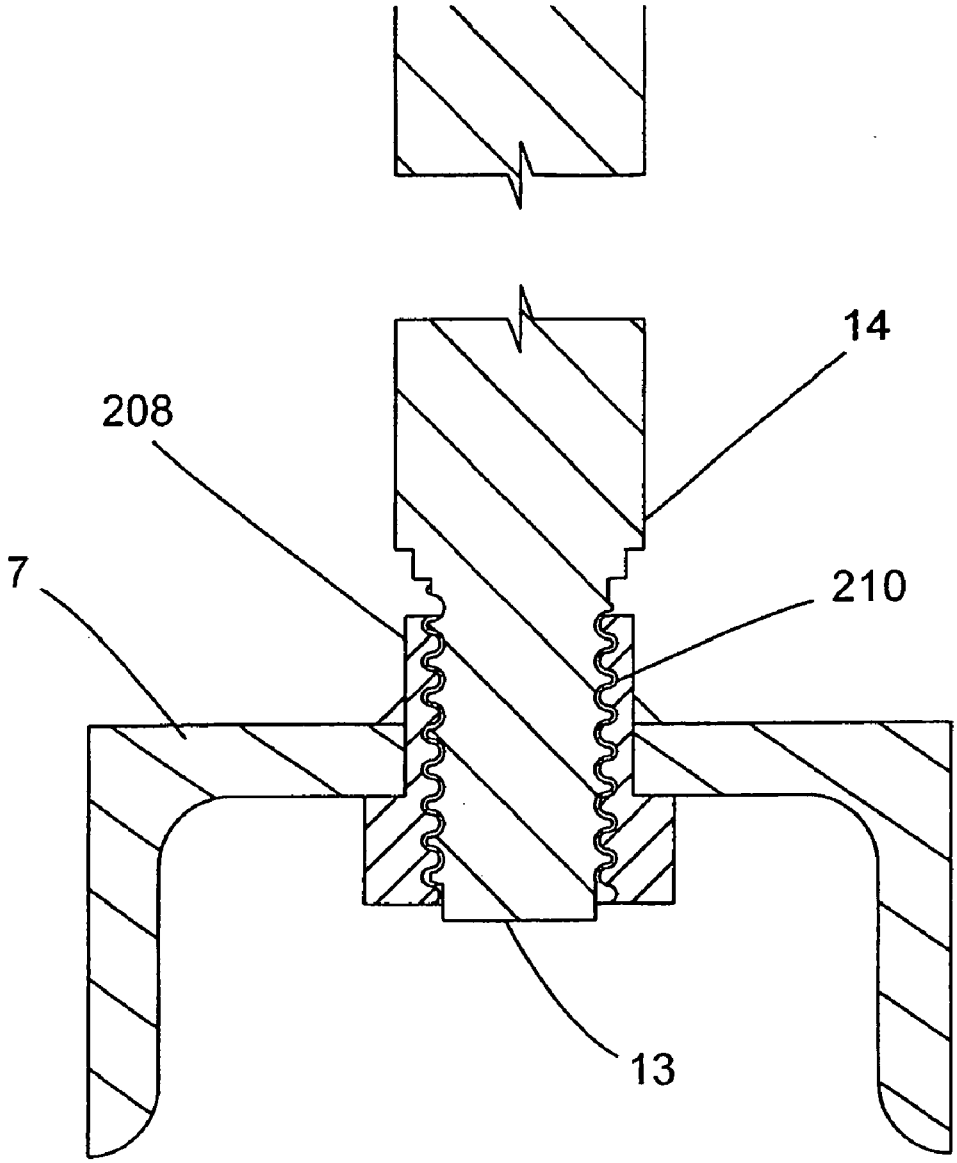
FIG. 4 is a cross-sectional view of a removable support device having a male screw thread securely fastened to the disposable base female screw thread.

FIG. 4 shows how a reusable support post device having shaft 14 is fastened to the disposable base 7. At the bottom of the support post is a male screw thread 13 that mates with female screw thread 210 in nut 208. Screwing a support post into the disposable base plate meets the OSHA strength requirements for building fall arrestors.

Figure 5:
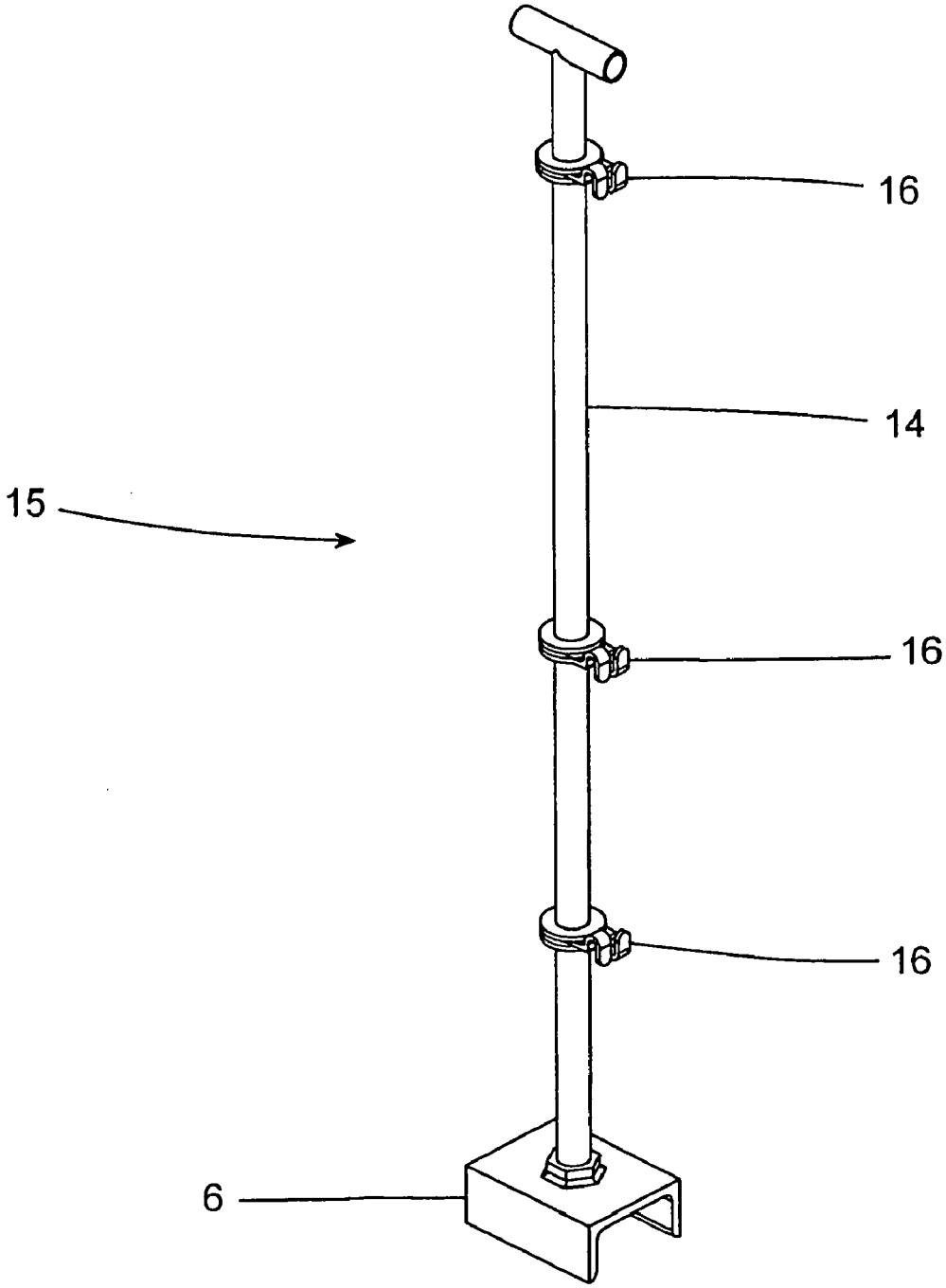
FIG. 5 is an isometric view of a removable support fence post securely fastened to a disposable base.
Figure 6:
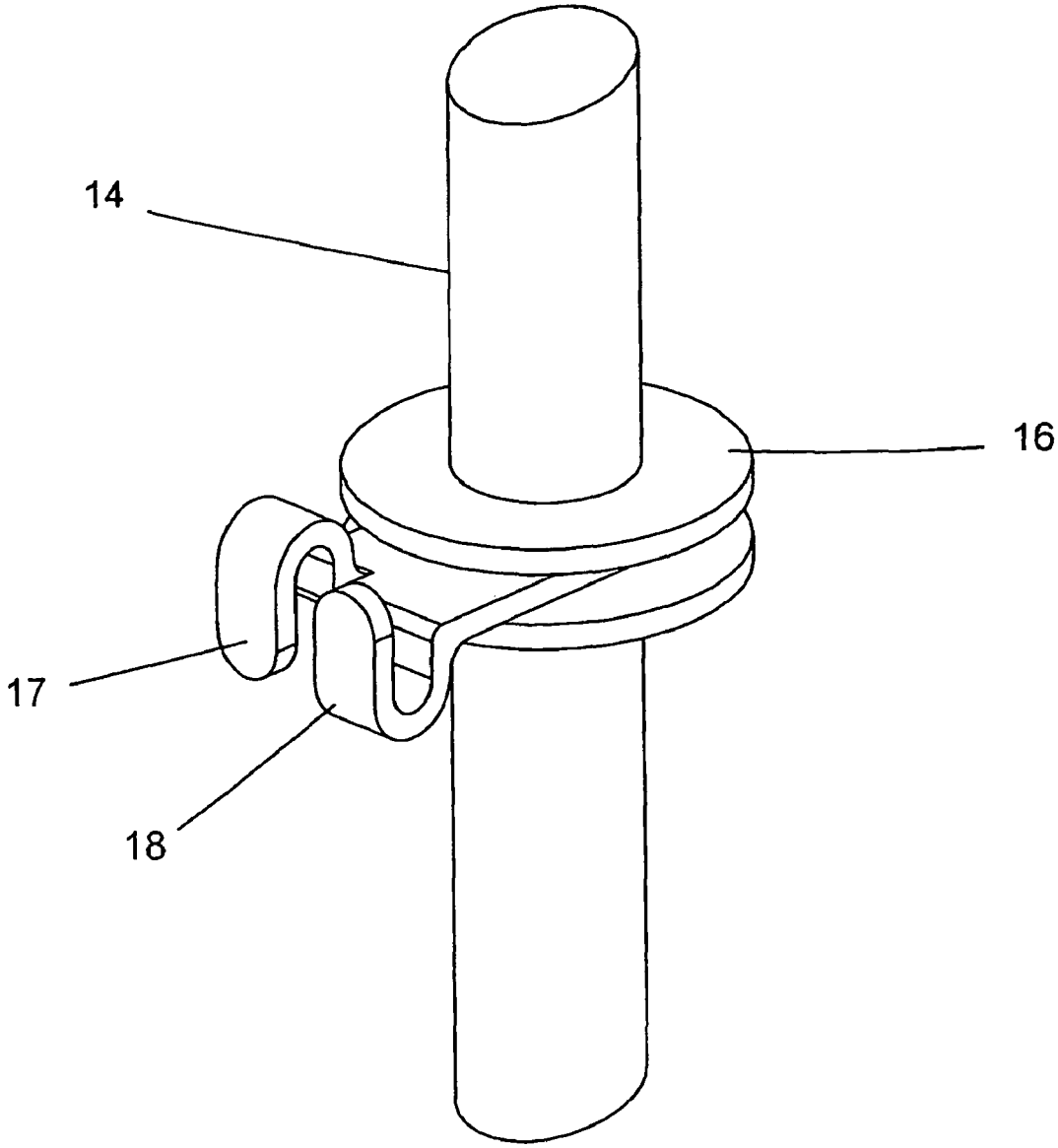
FIG. 6 is an enlarged isometric view of the cable support portion of the support fence post of FIG. 5.
Figure 7:
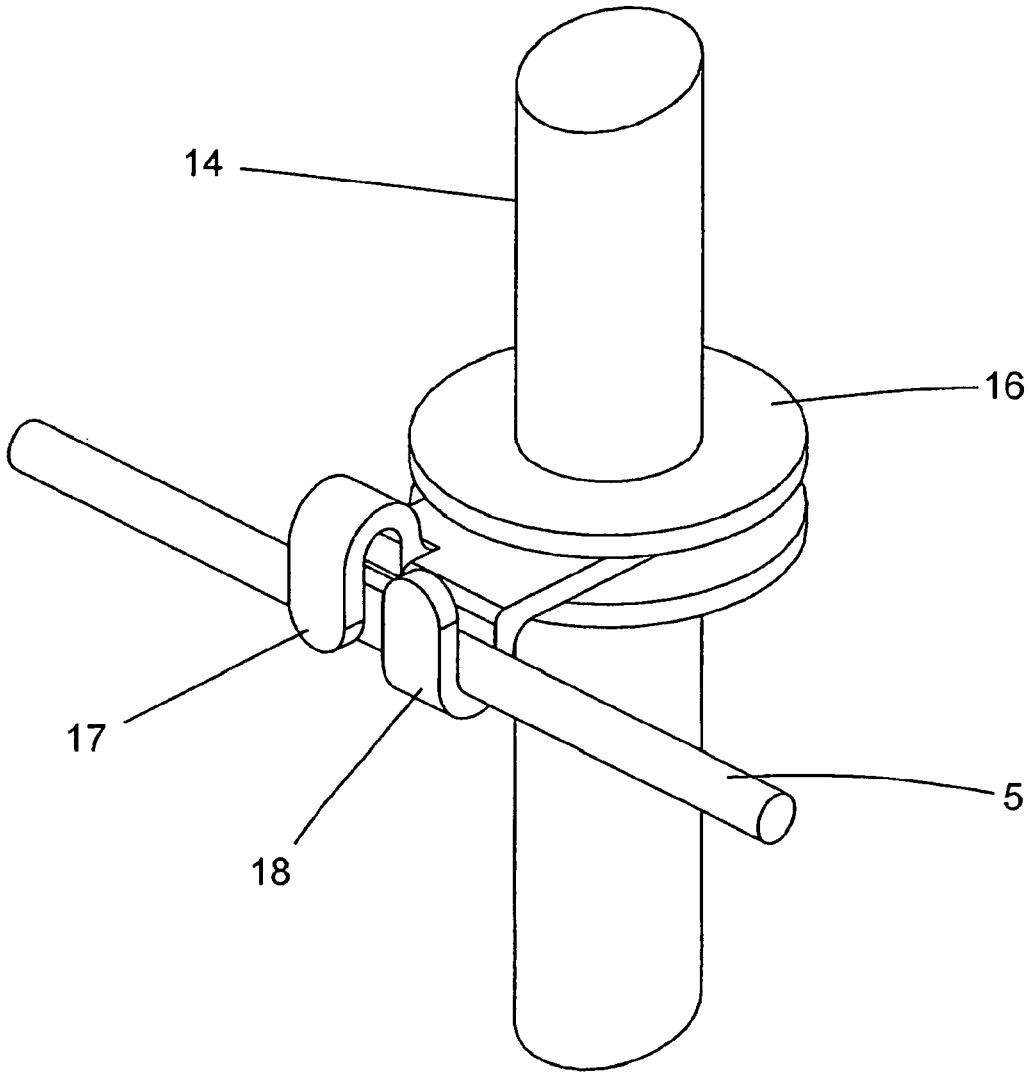
FIG. 7 is an enlarged isometric view of the support portion of the support fence of FIGS. 5 and 6 with a steel cable held securely in place.
Figure 8:
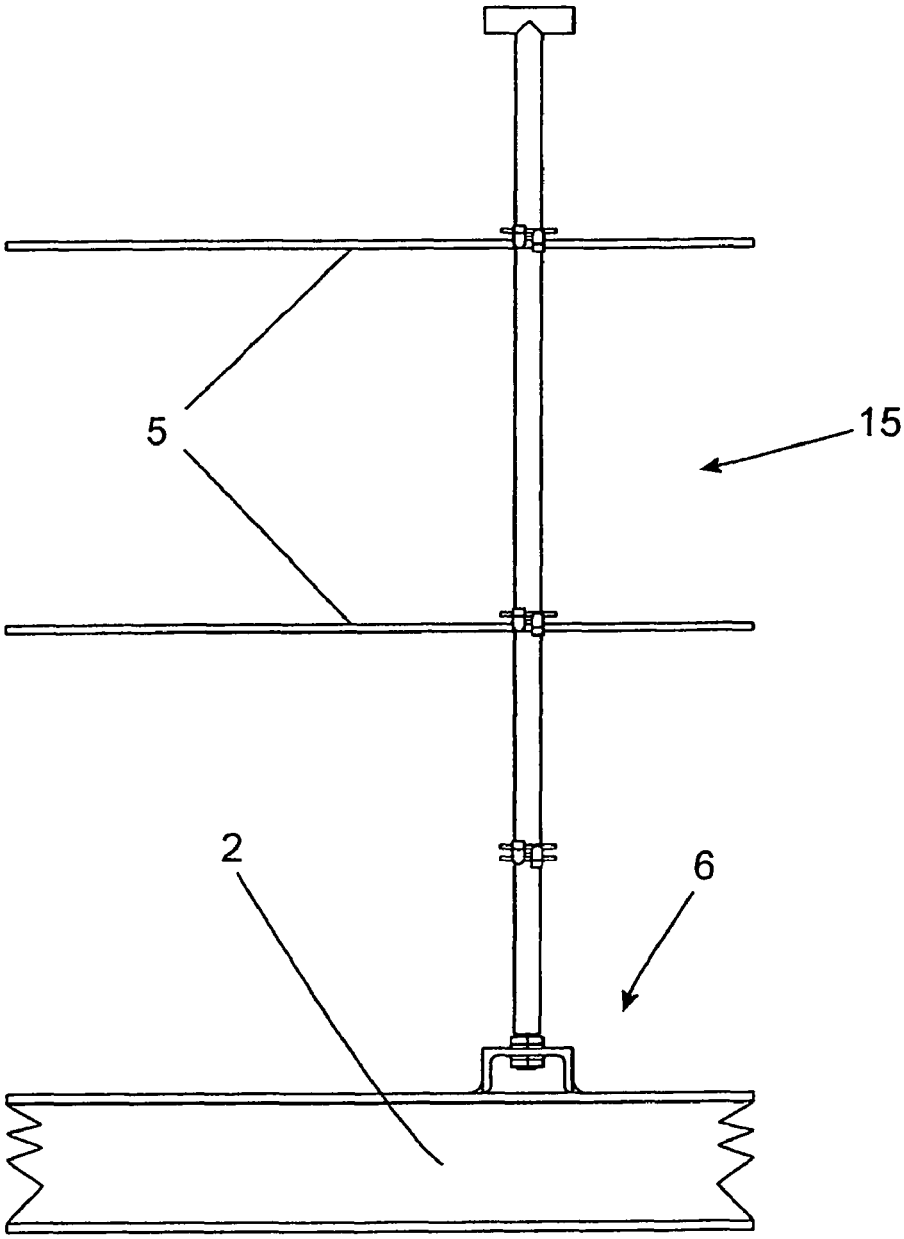
FIG. 8 is a front elevational view of a portion of the safely fence, showing one post.

FIG. 5 shows a typical reusable fall arresting support fence post 15 screwed into a disposable base 6. At various fixed height positions (determined by OSHA) along the post 14 are cable supports 16 through which steel cables may be threaded to form the fence. The cable supports 16 have a unique design. However, the fence posts may also have holes drilled through which the cables may be threaded. FIG. 6 is an enlarged isometric view showing an embodiment of the unique cable support 16 which is disclosed herein. Two plates 50 lock onto post 14 and sandwich a third plate 51 having steel fingers 17 and 18. Finger 17 is curved pointing upward while finger 18 is curved pointing downward. Referring to FIG. 7, when threaded, steel cable 5 is locked into place by fingers 17 and 18. FIG. 8 shows a single support post 15 as employed in the construction of the re-usable fence. In one embodiment, disposable bases 6 are first welded onto I-beam 2 at roughly eight-foot intervals. Then, re-usable support posts 15 are screwed into disposable bases 6. Finally steel cables 5 are threaded through the cable supports 16 to form the fence. Once construction of the story or the roof is complete, the cables are removed, the re-usable support posts are unscrewed, and the disposable bases are covered and become a permanent part of the structure.

Figure 9A:
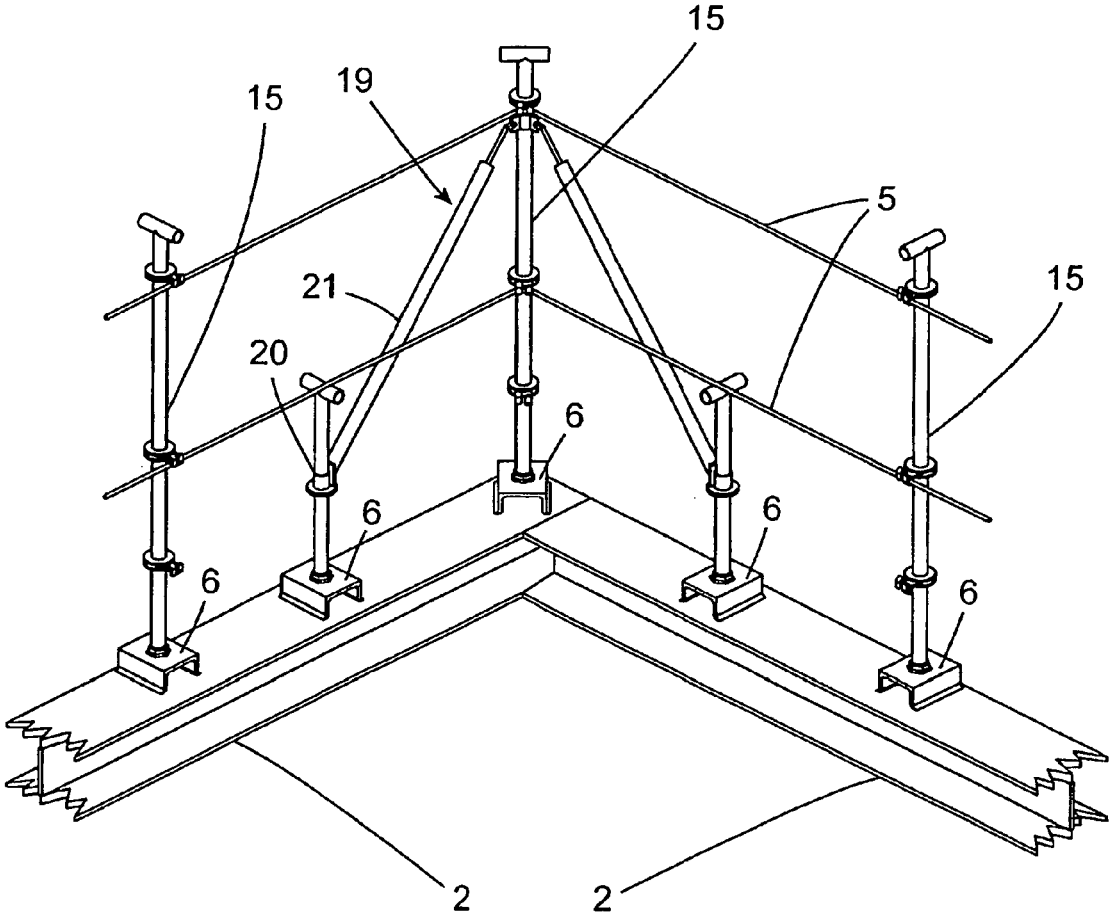
FIG. 9A is an isometric view of a corner portion of a safety fence according to the disclosure.
Figure 9B:
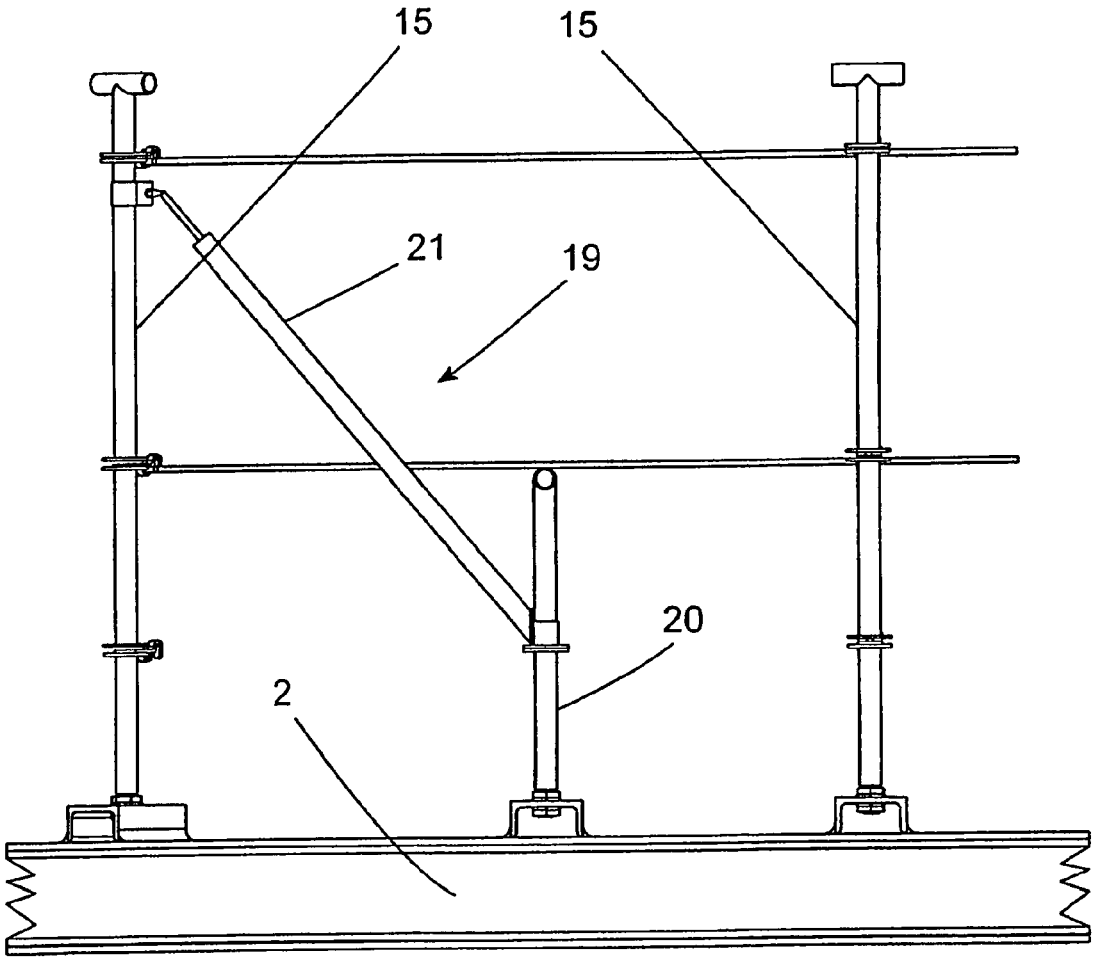
FIG. 9B is an elevational view of the corner of FIG. 9A.

Safety fences comprise a plurality of support posts 15 positioned along a building perimeter. However, a different structure is required. FIG. 9A is an isometric view of a corner post assembly. The corner post assembly 19 comprises support post 15 screwed into a disposable base 6 and adjustable rods 21 attached to small posts 20, each of which are screwed into disposable bases. The structure of the cable supports 16 on post component 15 allow the threaded cables to turn corners. By increasing the length of the adjustable rods 21, force is applied to the support post 15 and the small posts 20. The net effect of these force vectors is an outward force in the direction of the corner. FIG. 9B is a front elevational view of the corner post assembly.

Figure 10:
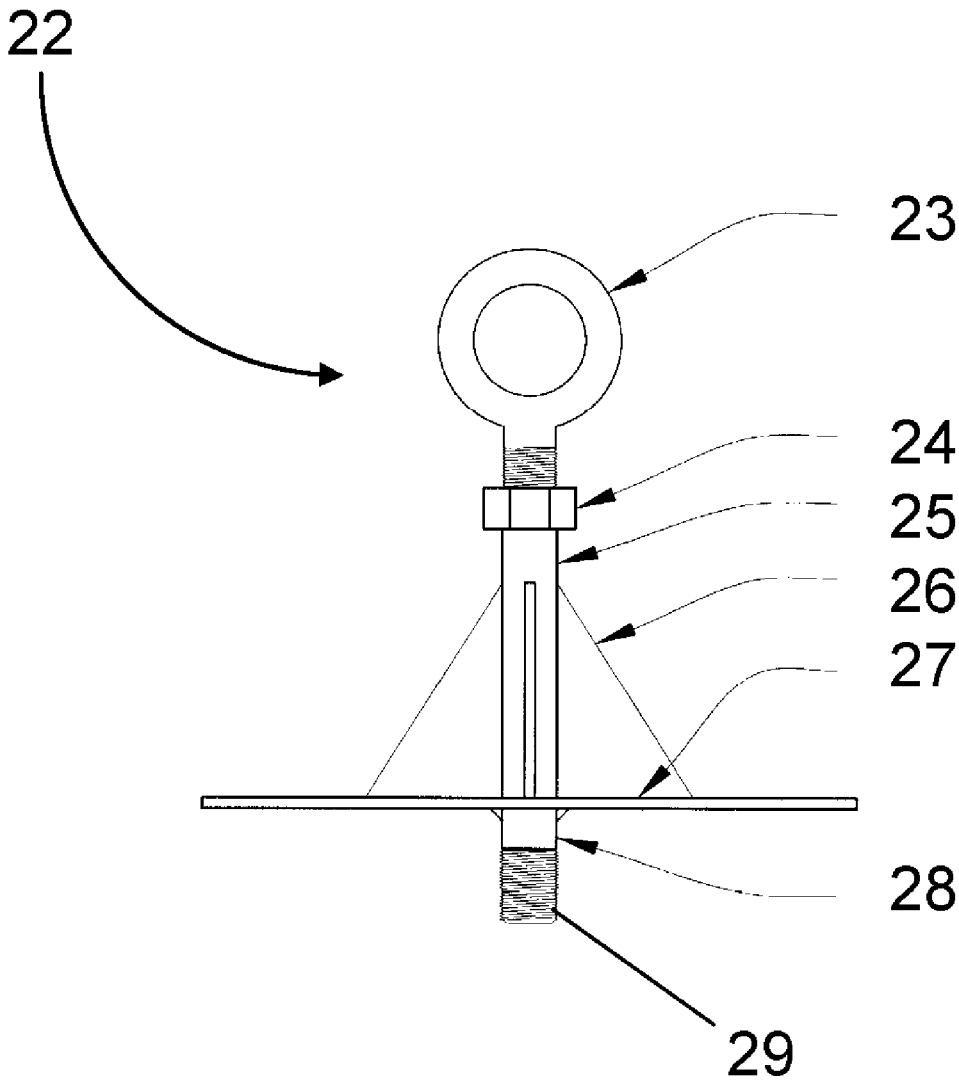
FIG. 10 is an elevational view of a reusable fall arrestor for use in the disclosed system.

After construction of the building story has been completed, and the safety fences have been removed, the disposable base plates still remain securely welded to the structure. At times, workers need to work on these completed or partially completed structures. FIG. 10 shows a unique fall arrestor device 22 that screws into the disposable base plates that are part of the disclosed structure. The fall arrestor comprises an eye bolt 23 that screws into a re-usable base assembly, such as those indicated by reference numeral 6. One embodiment of the re-usable fall arrestor 22 comprises a 1-inch pipe 25, a $\frac{3}{16}$×9 inch base plate 27, and a $4\frac{3}{16}$ inch gusset 26 welded to the pipe and base. The 1-inch pipe protrudes through the bottom of the base plate 27. The eye bolt is threaded throughout most of its length and is secured to the pipe using a 1-inch nut 24. The threaded bottom of the eye bolt 29 protrudes from the bottom portion of the pipe 28. This screw thread from the eye bolt will screw into one of the disposable bases 6 welded to an I-beam. The combination eye bolt and re-usable assembly securely attached to a disposable base provides excellent safety for workers. A worker needs only to hook onto the eye bolt, and he will be protected should he accidentally fall off the side of the building. The fall arrestor system provides a mechanism for construction workers to tether themselves onto regularly and conveniently placed removable eye bolts so that they can work at the perimeter of the building.

Figure 11:
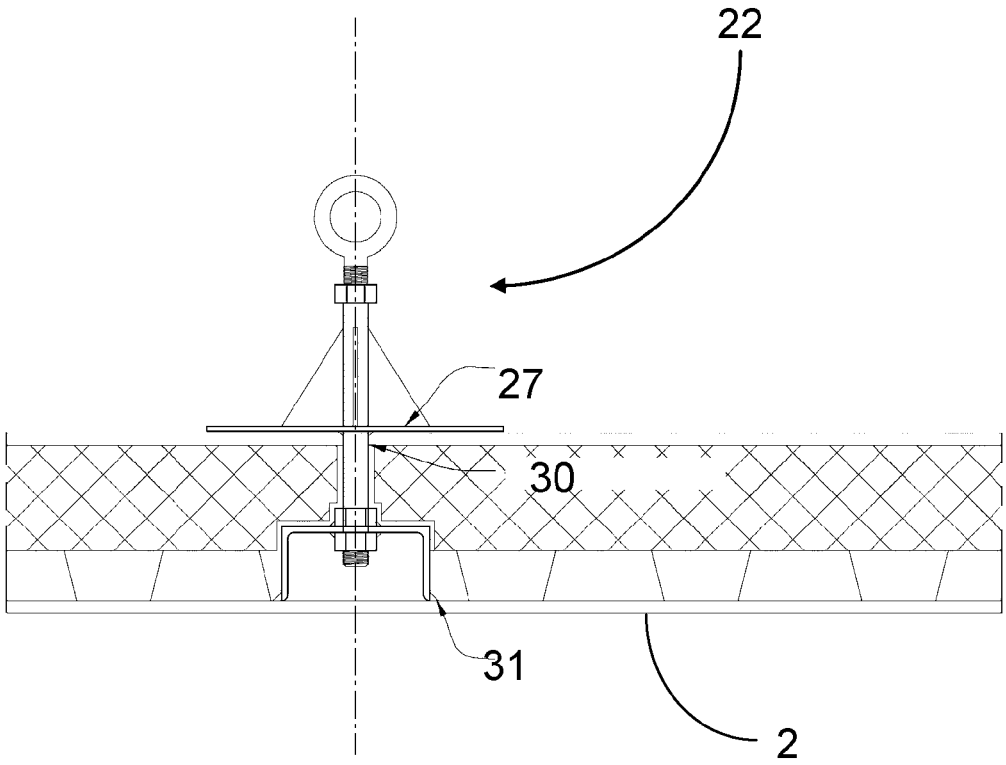
FIG. 11 is a cross sectional view of the reusable fall arrestor of FIG. 10 secured to an I-beam.

FIG. 11 is a cross sectional view showing an installed fall arrestor 22. The eye bolt is pushed through the re-usable base assembly, and the bottom of the eye bolt is screwed into a disposable base 6 that is welded to an I-beam 2 at weld junctions 31 (note that only the top surface of the I-beam 2 is depicted in FIG. 11). The disposable base 6 had been previously covered with flooring material, such that the fall arrestor base 27 can be forced into secure contact with the floor 30. An additional embodiment of the fall arrestor comprises a D-ring instead of an eye bolt.

Employing the disclosed system saves in excess of 1.5 labor hours per unit as compared to known systems. The posts can be reused (recycled) as opposed to the known practice of discarding, resulting in substantial cost savings. After roof installation, a perimeter of bases positioned every eight feet (distance D in FIGS. 14A and 14B) is left. A six-inch patch 66 identifies the location of each base plate for future use.

To install a fall arrestor 22, one only needs to make an incision into the six-inch patch, and install the eyebolt and gusset support into the base plate. When it the fall arrestor 22 is no longer needed, the eyebolt is unscrewed, the gusset is removed, and installation can proceed in a different location.

Referring to FIG. 12A-12D, another embodiment 32 of the invention comprises the use of a base 6" attached to a plate 33 with holes 34 designed to allow attachment by screwing into a work surface. Welding the base is not a possibility in such cases when an I-beam is not available, so a plate with a dispersed pattern of holes for attachment to the edge of a work surface is necessary. FIG. 12A is an isometric view of a re-useable base. FIG. 12B is a front elevational view and FIG. 12C is a side elevational view of the embodiment of FIG. 12A. Note that the base 6" is welded to the plate 33 at weld seams 35 on either side of the C-Channel.

FIG. 13A-13D shows a concrete base plate 36 for use in structural concrete rather than steel I-beam construction. This concrete base plate can be secured with rebar and/or by screws to framing prior to pouring concrete. It fits and mates with standard re-usable posts, like those previously disclosed as reference numeral 14. FIG. 13A is an isometric view showing a three-part assembly. Two right angle brackets 39 are screwed into the floor surface via holes on surface 44 (shown in FIG. 13B and FIG. 13C). These brackets 39 will be covered with poured concrete up to a certain height. Holes 41 appear in two columns along the vertical surfaces of brackets 39. Mating holes appear in the C-Channel device 40. The holes 41 of the upper assembly 40 mate with their corresponding holes in lower assembly 39. The upper and lower assemblies 40 and 39 are attached with bolts 42 and nuts 43. FIG. 13B is a top plan view of the assembly, while FIG. 13C and FIG. 13D are front and side elevational views, respectively.

I claim the following:

1. A reusable modular system for fall restrain support and fall arrest of individuals comprising:

a) at least one disposable base permanently attached to an I-beam, a floor or a roof, comprising a C-channel with a generally horizontal top portion and two downwardly extending vertical flanges, defining an inner surface between the vertical flanges and an outer surface, the C-channel defining a vertical bore extending through the top portion from the outer surface to the inner surface;

a top nut with an upper threaded bore welded to the top portion on the outer surface in a position wherein the upper threaded bore and vertical bore are substantially coaxial; and, a bottom nut with a lower threaded bore welded to the top portion on the inner surface in a position wherein the lower threaded bore is substantially coaxial with the vertical bore and upper threaded bore;

b) at least one re-usable post having a vertical height comprising a threaded cylindrical bottom portion configured to mate with the upper and lower threaded bores; wherein the at least one re-usable post is rigidly removably engaged with the at least one disposable base in a substantially vertical position by mating the threaded cylindrical bottom portion with the upper and lower threaded bores such that the re-usable post can be disengaged from the disposable base as desired.

2. The system of claim 1 wherein the at least one disposable base is welded to an I-beam at the outer surface of both vertical flanges.

3. The system of claim 1 further comprising a plurality of disposable bases and an equal number of re-usable posts.

4. The system of claim 3 wherein each of the re-usable posts further comprise at least one cable support unit to accommodate the threading of a cable.

5. The system of claim 4 wherein each cable support unit comprises an upwardly extending finger horizontally spaced from a downwardly extending finger.

6. The system of claim 5 wherein at least one cable is threaded through and substantially vertically restrained by the upwardly and downwardly extending fingers.

7. The system of claim 4 further comprising at least one cable threaded through and vertically retained by the cable support unit of each of the re-usable posts.

8. The system of claim 7 wherein the disposable bases, posts, and the cable are positioned to form a perimeter having a plurality of corners.

9. The system of claim 8 further comprising a post assembly having a) a re-usable post removably attached to a disposable base positioned proximate a corner of the perimeter, defining a corner post through which at least one cable is threaded;

b) two re-usable posts positioned vertically adjacent the corner post in positions whereby a line extending from one adjacent post to the corner post to the other adjacent post is not parallel; and, c) two extension rods having, each being adjustable to a plurality of lengths and having opposite ends, each extension rod positioned obliquely between the corner post and one adjacent post with one end attached to the corner post and the other end attached to the adjacent post, wherein adjustment of the extension rods from one length to a greater length causes the corner post to increase in rigidity yielding increased tension in the at least one cable.

10. The system of claim 1 wherein the at least one re-usable post further comprises an eye bolt.

11. The system of claim 1 wherein the at least one disposable base further comprises:

a) a plurality of through-holes passing through both of the two vertical flanges of the C-Channel, said through-holes in each vertical flange passing completely from the outside surface to the inside surface;

b) two right-angle brackets, the sides of which are substantially perpendicular, wherein one side of each right-angle bracket comprises through-holes passing completely through the side;

c) fasteners that pass through the through-holes each right-angle bracket and the through-holes in each of the two vertical flanges of the C-Channel;

wherein an assembly is formed between the two right angle brackets and the C-Channel, such that:

a right-angle bracket is removably attached to each vertical flange of the C-Channel in such a way that one side of each right-angle bracket is positioned vertically and the other side of each right-angle bracket is positioned horizontally;

some of the through-holes in the vertically positioned side of each right-angle bracket are positioned to mate with some of the through holes of each vertical flange of the C-Channel to enable fastening of the right angle brackets to each vertical flange using the fasteners; and, the vertical sides of each of the two right-angle brackets are fastened to the vertical flanges of the C-Channel such that the vertical height of the disposable base is made greater and the horizontally positioned sides of both of the right angle brackets are positioned in a direction away from each other.

12. The system of claim 11 further comprising through-holes passing through the horizontally positioned sides of both right-angle brackets so as to enable fasteners to pass through said through-holes in a manner as to fasten the disposable base to a roof or floor.

13. The system of claim 12 wherein the fasteners that fasten the disposable base to the roof or floor is a rebar.

14. The system of claim 11 wherein the disposable base is held in position on a roof or floor by pouring cement or concrete to cover a portion of the disposable base.

15. The system of claim 1 wherein the disposable base is welded to a portable metal plate at the outside surface of the vertical flanges to form a re-roofing base assembly such that the weld junctions between the disposable base and the metal plate are the ends of both vertical flanges.

16. The system of claim 15 wherein the metal plate of the re-roofing base assembly comprises through-holes.

17. The system of claim 16 wherein at least one re-usable post is screwed into at least one re-roofing base assembly.

18. The system of claim 1 wherein the top and bottom nuts are merged to form a single nut with a female screw thread, with said single nut being inserted into and passing through the center cylindrical hole in the C-channel so that a line extended through the center of the cylindrical hole of the single nut coincides with a line extended through the center cylindrical hole passing through the horizontal top portion of the C-Channel, and such that part of the nut protrudes above the outside surface of the horizontal top portion, and part of the nut protrudes below the inside surface of the horizontal top portion.

19. A reusable modular system for fall restrain support and fall arrest of individuals comprising:

at least one disposable base permanently attached to an I-beam, a floor or a roof, comprising a C-channel with a generally horizontal top portion and two downwardly extending vertical flanges, defining an inner surface between the vertical flanges, an outer surface, and a vertical bore extending through the top portion from the outer surface to the inner surface;

a first nut defining a threaded bore permanently fixed to the top portion substantially coaxial to the vertical bore; and, at least one re-usable post having a vertical height comprising a threaded cylindrical bottom portion configured to mate with the threaded bore; wherein the at least one re-usable post is rigidly removably engaged with the at least one disposable base in a substantially vertical position by mating the threaded cylindrical bottom portion with the threaded bore such that the re-usable post can be disengaged from the disposable base as desired.

20. The reusable modular system of claim 19, wherein the first nut extends through the vertical bore of the top portion.

21. The reusable modular system of claim 19, wherein the first nut is welded to the outer surface of the top portion, comprising an additional nut welded to the inner surface of the top portion substantially coaxial to the first nut and the vertical bore.

* * * * *

UNITED STATES PATENT AND TRADEMARK OFFICE

CERTIFICATE OF CORRECTION

PATENT NO. : 7,802,773 B2
APPLICATION NO. : 12/047125
DATED : September 28, 2010
INVENTOR(S) : Murphy It is certified that error appears in the above-identified patent and that said Letters Patent is hereby corrected as shown below:

Column 6:

Line 11, before "posts" insert --re-usable--.

Signed and Sealed this

Twenty-first Day of December, 2010

David J. Kappos

David J. Kappos
*Director of the United States Patent and Trademark Office*